US005406723A

United States Patent [19]

Okajima

[11] Patent Number: 5,406,723

[45] Date of Patent: Apr. 18, 1995

[54] MULTIPLE LAYER CYCLING SHOE SOLE

[75] Inventor: Shinpei Okajima, Izumi, Japan

[73] Assignee: Shimano Inc., Osaka, Japan

[21] Appl. No.: 141,693

[22] Filed: Oct. 26, 1993

Related U.S. Application Data

[63] Continuation of Ser. No. 754,667, Sep. 4, 1991, abandoned.

[30] Foreign Application Priority Data

Sep. 7, 1990 [JP] Japan ..... 2-237762

[51] Int. Cl.[6] ..... A43B 5/00

[52] U.S. Cl. ..... 36/131; 36/30 R

[58] Field of Search ..... 36/131, 134, 135, 30 R, 36/31, 67 R, 98, 107, 25 R, 44, 67 A, 67 B, 67 C

[56] References Cited

U.S. PATENT DOCUMENTS

| | | | |
|---|---|---|---|
| 3,989,789 | 11/1976 | Brookhart | 264/136 |
| 4,231,169 | 11/1980 | Toyama et al. | 36/76 C |
| 4,488,453 | 12/1984 | Drugeon et al. | 36/131 |
| 4,651,445 | 3/1987 | Hannibal | 36/140 |
| 4,688,338 | 8/1987 | Brown | 36/44 |
| 4,874,640 | 10/1989 | Donzis | 36/37 |
| 4,990,207 | 2/1991 | Sakai et al. | 156/242 |
| 5,086,576 | 2/1992 | Lamson | 36/131 |
| 5,142,797 | 9/1992 | Cole, III | 36/113 |

*Primary Examiner*—Paul T. Sewell
*Assistant Examiner*—Thomas P. Hilliard
*Attorney, Agent, or Firm*—Dickstein, Shapiro & Morin

[57] ABSTRACT

The present invention provides a light and strong cycling shoe sole. A shoe according to the present invention includes a core, fibrous layers surrounding the core to reinforce the core, and a resin for integrating the fibrous layers and core.

2 Claims, 4 Drawing Sheets

MULTIPLE LAYER CYCLING SHOE SOLE

This application is a continuation of application Ser. No. 07/754,667, filed Sep. 4, 1991, now abandoned.

BACKGROUND OF THE INVENTION

1. Field of the Invention

This invention relates to cycling shoe soles and methods of manufacturing the cycling shoe soles.

2. Description of the Related Art

Conventionally, cycling shoe soles are formed, for example, of a resin or the like mixed with glass fiber chips for reinforcement.

With the above construction, the sole is subjected to a strong bending force applied longitudinally of the shoe at a pedaling time. Therefore, the sole is formed solid to withstand the bending force. This is because an improved strength can hardly be expected of the sole having the glass fiber chips arranged in random orientation without fiber layers. Consequently, the sole itself is heavy, and the cyclist must ride a bicycle by pedaling hard with heavy soles, which has the disadvantage of exhausting the cyclist.

SUMMARY OF THE INVENTION

An object of the present invention is to provide a sole of a cycling shoe which is very light and yet has a sufficient durability against a strong bending force acting longitudinally of the shoe, a method of manufacturing such shoe soles.

In a first aspect of the present invention, the above object is fulfilled by a cycling shoe sole comprising a light core, fibrous layers surrounding the core to reinforce the core, and a resin for integrating the fibrous layers and the core.

According to this structure, the entire shoe sole is formed lightweight in the absence of unnecessary reinforcing element since a light core is surrounded by fibrous layers and integrated together by a resin. The fibrous layers are formed of a woven or nonwoven fabric for reinforcing the core, which gives sufficient strength to the entire shoe sole.

In a second aspect of the invention, the fibrous layers in the above structure are sheet layers of carbon fiber.

According to this structure, the fibrous layers acting as a main reinforcement include light and strong carbon fibers to promote the reinforcing effect.

As a third aspect of the invention, the cycling shoe according to the present invention may include a cleat or shoe plate mount, and the fibrous layers may include a first sheet layer applied to at least one of upper and lower surfaces of the core with fibers extending longitudinally of the shoe, a second sheet layer applied to a position of the core corresponding to the mount with fibers extending transversely of the shoe, and a third sheet layer of carbon cloth overlying the first and second sheet layers and the core, and wherein the core is formed of a light resin, the resin integrating the first to third sheet layers and the core.

According to this structure, the first sheet layer with the fibers extending longitudinally of the shoe sufficiently withstands a bending force acting longitudinally of the shoe. The cleat mount is subjected to a strong bending force acting transversely of the shoe, which results from treading on or pull-up of a bicycle pedal. However, the second sheet layer, with the carbon fibers extending transversely of the shoe on the position of the core corresponding to the cleat mount, effectively safeguards the sole against damage due to a strong treading force applied thereto. The third sheet layer acts to prevent separation of the first and second sheet layers and the core.

Carbon fiber has a good tensile strength but its compressive strength is low. Therefore, sheets of carbon fiber and not carbon cloth are used as the first and second sheet layers acting as the main reinforcement. If the first and second sheet layers were formed of carbon cloth, the fibers extending zigzag to form the cloth would produce a compressive stress, thereby to lack in strength. The present invention is free from such inconvenience.

A method of manufacturing a cycling shoe sole according to the present invention comprises the steps of wrapping a light core with previously impregnated sheets containing reinforcing fibers, and integrating the core and the previously impregnated sheets by press working and hardening of the resin in the prepreg sheets.

According to the shoe sole manufacturing method of this invention, reinforcing fibrous layers are formed and integrated with the core. For this purpose, previously impregnated sheets with carbon fibers impregnated with a resin are used, which are subjected to press working and the resin is allowed to harden. The sheet layers adhere to the core in a reliable way with little chance of voids being formed therein. Consequently, a strong shoe sole may be manufactured by this method. This manufacturing method is simple and is carried out at low manufacturing cost since it only involves press working of the core and prepreg sheets applied thereto.

As described above, the present invention provides a cycling shoe sole and a method of manufacturing the shoe sole which is very light as a whole while having a sufficient durability against a strong bending force acting longitudinally of the shoe. The shoe having such a shoe sole alleviates fatigue or exhaustion of the cyclist due to pedaling action. The sole manufacturing method according to the present invention is capable of manufacturing a light and strong shoe sole in a simple process and at low cost.

Other objects, features and advantages of the present invention will be apparent from the following description of the preferred embodiments.

BRIEF DESCRIPTION OF THE DRAWINGS

The drawings show a cycling shoe sole and a method of manufacturing the shoe sole according to the present invention, in which.

DETAILED DESCRIPTION OF THE PREFERRED EMBODIMENTS

An embodiment of the present invention will be described next with reference to the drawings.

Figure 4:
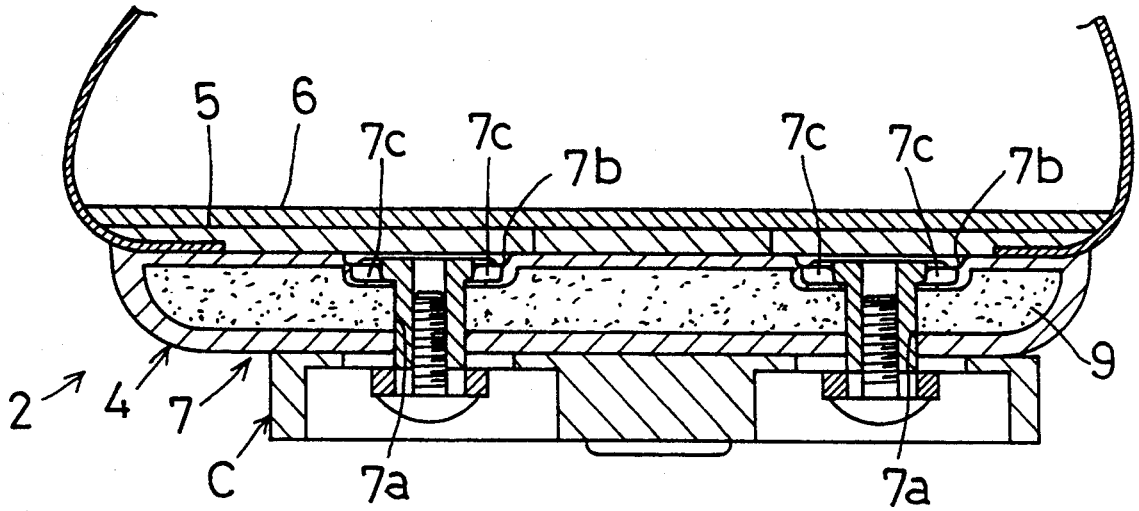
FIG. 4 is a view in vertical section showing a cleat mounted in position.
Figure 6:
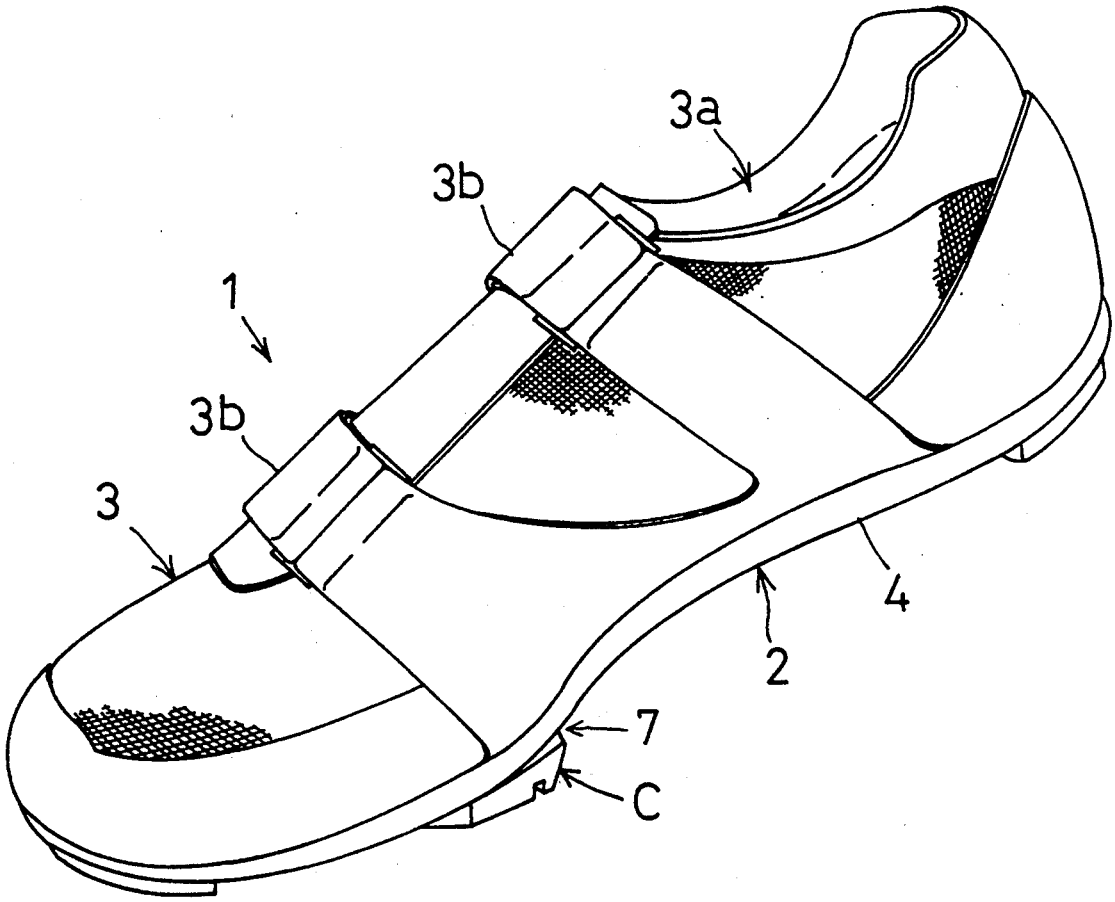
FIG. 6 is a perspective view of an entire shoe.
Figure 5:
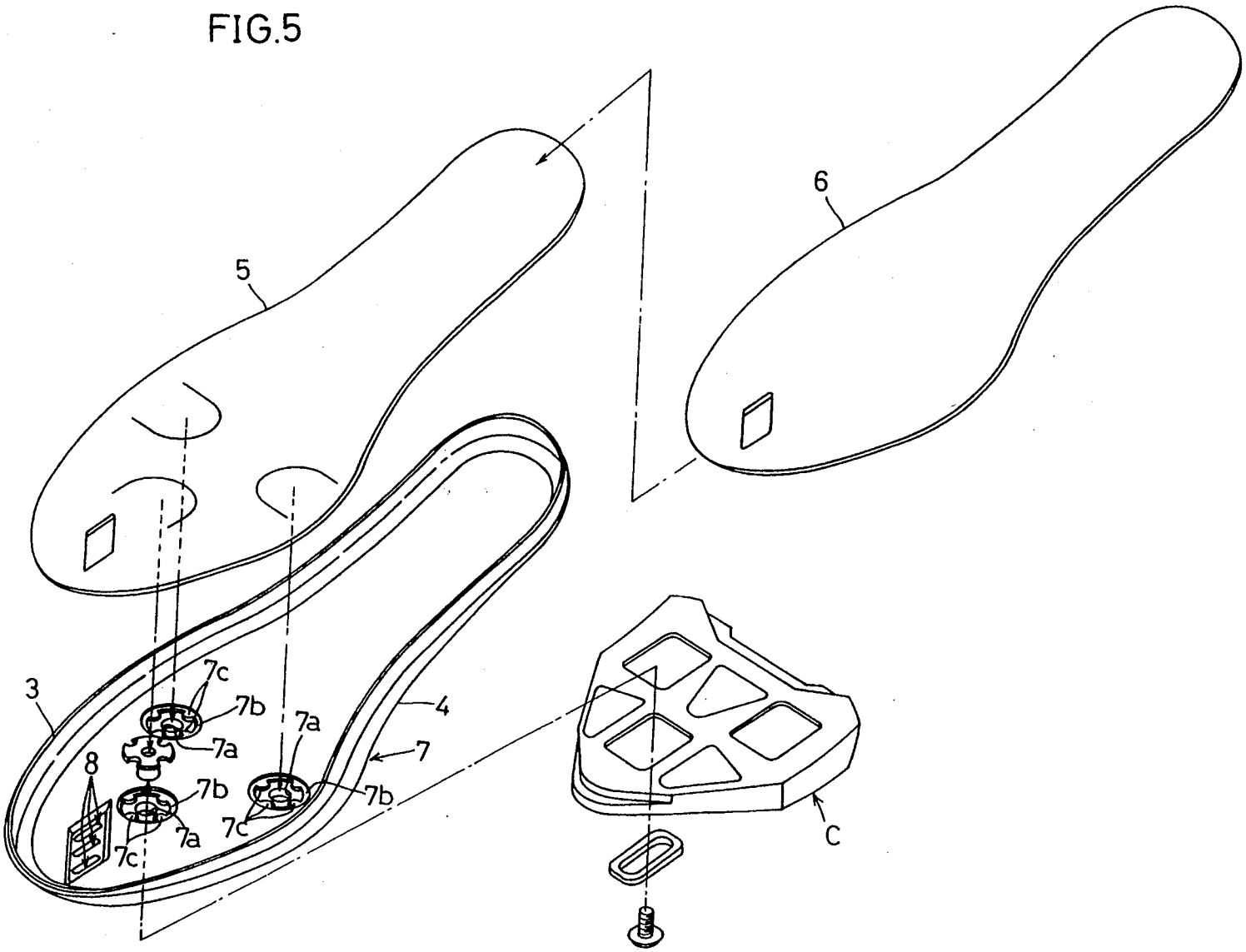
FIG. 5 is an exploded perspective view of the sole.

FIG. 6 shows a cycling shoe 1 having a cleat C attached thereto for connection to what is known as a clipless pedal. As shown in FIGS. 4 and 5, the cycling shoe 1 includes a sole 2 and a quarter 3 as main components thereof. The sole 2 includes a hard outsole 4, a soft insole 5 placed on the outsole 4, and a soft platform 6 placed on the insole 5. The sole 2 defines a cleat mount 7 in a position corresponding to the ball of a foot. The cleat mount 7 includes bolt receiving bores 7*a*, and nut receiving recesses 7*b*. Numeral 7*c* denotes stoppers for preventing turning of nuts screwed to bolts. The sole 2 further includes a plurality of air holes arranged in a forward portion thereof. The quarter 3 is formed of nylon cloth or synthetic rubber, and includes two felt fastener type straps 3*b* for tightening the instep of a foot inserted through an opening 3*a*.

Figure 1:
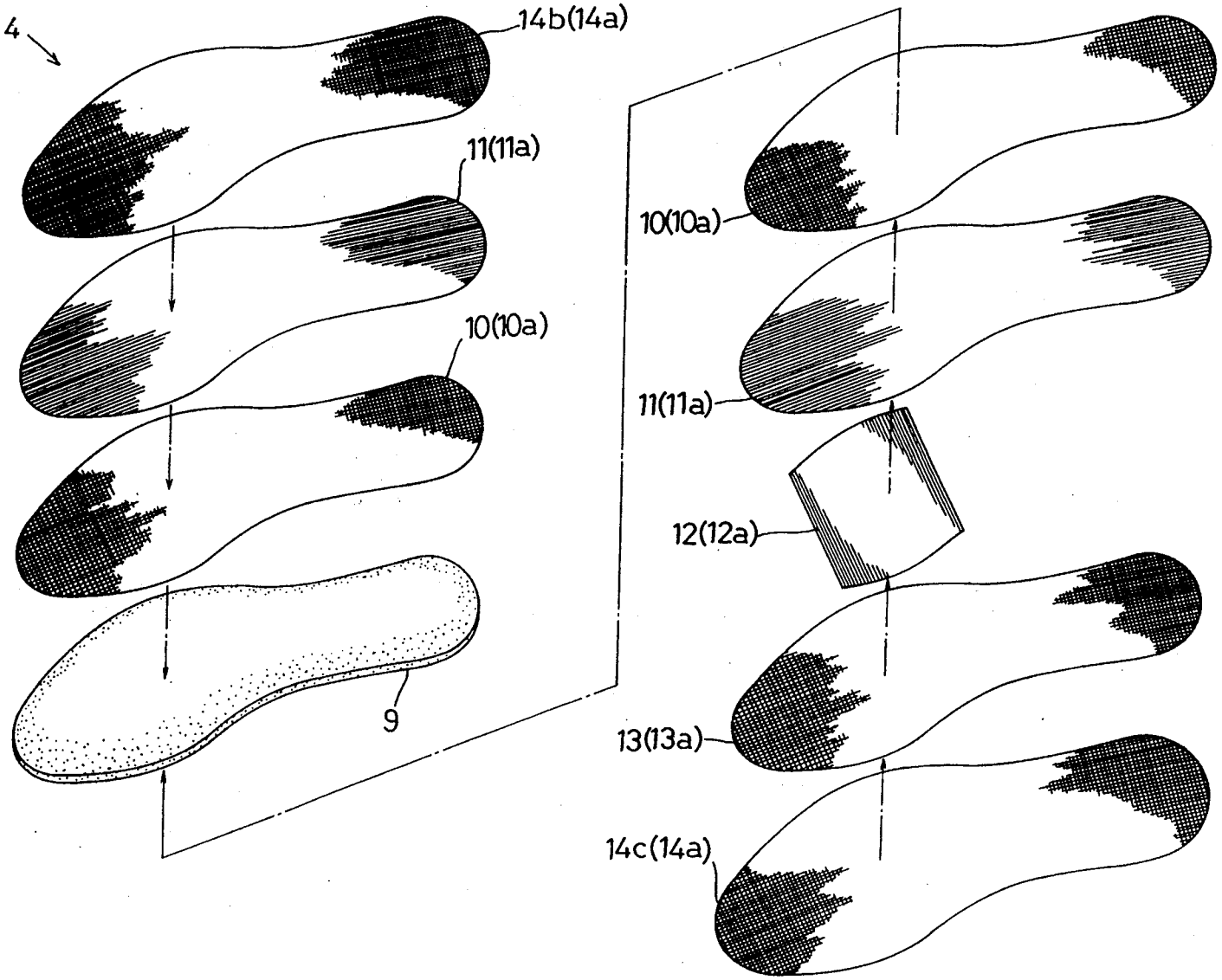
FIG. 1 is an exploded perspective view showing various layers.
Figure 2:
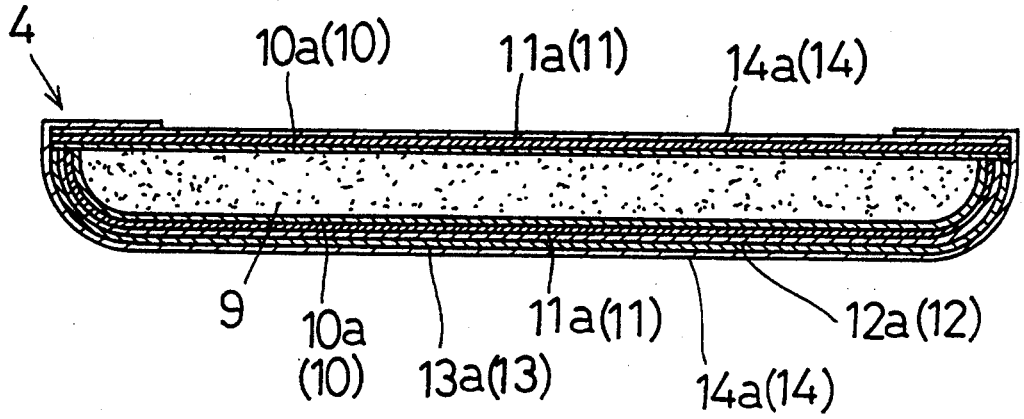
FIG. 2 is a view in vertical section showing the sole prior to press working.
Figure 3:
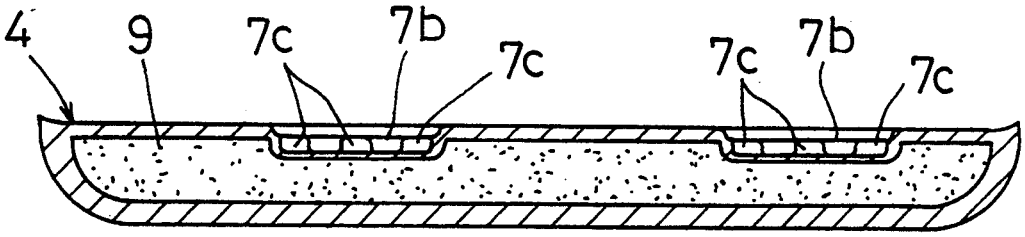
FIG. 3 is a view in vertical section showing the sole after press working.

A method of manufacturing the outsole 4 will be described next with reference to FIGS. 1 and 2. This method uses carbon fiber and glass fiber previously impregnated sheets, the former being lighter than the latter, and a thermosetting resin such as phenol resin for impregnating these fibers. The first and second previously impregnated sheets 11 and 12 described below comprise what is known as UDCF which has reinforcing fibers extending in one direction.

A core 9 of the outsole 4 is formed of polyurethane foam, and then a previously impregnated sheet 10 of glass cloth is applied to upper and lower surfaces of the core 9 to form first auxiliary sheet layers 10*a*. These layers 10*a* are used to promote cohesion between the polyurethane core 9 and carbon fiber previously impregnated sheets.

First previously impregnated sheets 11 of carbon fiber are applied to the upper and lower surfaces of the core 9, with the fibers extending longitudinally of the shoe, to form first sheet layers 11*a*.

A second previously impregnated sheet 12 of carbon fiber is applied to a position on the lower surface of the core 9 corresponding to the cleat mount 7, with the fibers extending transversely of the shoe, to form a second sheet layer 12*a*.

A previously impregnated sheet 13 of glass cloth is applied to the lower surface of the core 9 to form a second auxiliary sheet layer 13*a*.

The core 9 having the various layers formed in the foregoing process is wrapped in a third previously impregnated sheet 14 of satin weave carbon cloth forming a third sheet layer 14*a*. The third previously impregnated sheet 14 includes a previously impregnated sheet 14*b* applied to the upper surface of the core 9, this previously impregnated sheet 14*b* having substantially the same area as the upper surface of the core 9, and a previously impregnated sheet 14*c* having a larger area and applied to the lower surface of the core 9 to overlap the upper previously impregnated sheet 14*b*.

The outsole 4 having the various layers is placed in dies and shaped by pressurization and heating. Consequently, the outsole 4 is completed with the impregnated resin of the previously impregnated sheets 10–14 hardened by the heat. Where phenol resin is used as the impregnated resin, the heating temperature is 140° C. and the pressing time about 2 hours, for example. The pressure is applied to a degree to prevent expansion of the core 9. At this time, secondary foaming of the polyurethane resin of the core 9 is prevented.

The bolt receiving bores 7*a* and air holes 8 may be formed by drilling after the second step. The recesses 7*b* and stoppers 7*c* are formed in the above press working.

In the first to sixth steps, the first auxiliary sheet layer 10*a*, the first sheet layer 11*a*, the second sheet layer 12*a*, the second auxiliary sheet layer 13*a* and the third sheet layer 14*a* are arranged successively downwardly from the lower surface of the core 9 to constitute a lower part of the outsole 4, whereas the first auxiliary sheet layer 10*a*, the first sheet layer 11*a* and the third sheet layer 14*a* are stacked successively upwardly from the core 9 to constitute an upper part of the outsole 4.

The cycling shoe 1 having the outsole 4 formed by the above manufacturing method includes no unnecessary reinforcing element. Since the first and second sheet layers 11*a* and 12*a* acting as main reinforcements contain light and strong carbon fibers, the entire sole 2 is lightweight while maintaining a high degree of strength. The first sheet layers 11*a*, with the carbon fibers extending longitudinally of the shoe 1, sufficiently withstand a bending force acting longitudinally of the shoe 1. The sole 2, particularly the cleat mount 7, is subjected to a strong bending force acting transversely of the shoe, which results from treading on or pull-up of a bicycle pedal. However, the second sheet layer 12*a*, with the carbon fibers extending transversely of the shoe on the position of the core 9 corresponding to the cleat mount 7, effectively safeguards the sole 2 against damage due to a strong treading force applied thereto.

Other embodiments of the present invention are set out hereunder.

I. In the foregoing embodiment, the second previously impregnated sheet 12 is applied only around the mount 7. The second prepreg sheet 12 may be applied to an entire surface of the outsole 5 instead. The first and second previously impregnated sheets 11 and 12 may be applied to either the upper surface or the lower surface of the core 9. These sheets 11 and 12 may be applied in a different order.

A greater strength is provided where the first previously impregnated sheets 11 and 12 are applied to the lower surface of the core 9 than where these sheets 11 and 12 are applied to the upper surface of the core 9.

II. A shoe plate instead of the cleat C may be attached to the mount 7.

III. In the foregoing embodiment, the thermosetting phenol resin is used for the previously impregnated sheets 10–14. It is also possible to use a thermoplastic resin or other resins that hardens with lapse of time. It is to be noted that the term "resin" used in the claims includes both synthetic and natural resins.

IV. In the foregoing embodiment, the outsole 4 is manufactured using the prepreg sheets 10–14. However, sheets 10*a*–14*a* of carbon fiber and carbon cloth may first be placed on the core 9 and thereafter impregnated with the resin.

V. While in the foregoing embodiment, the outsole 4 is formed by press working, the outsole 4 may be formed by a different pressuring process. Further, it is not necessary for the resin in the previously impregnated sheets 10–14 to harden during the press working process.

VI. In the foregoing embodiment, the present invention is applied to the hard outsole 4. Instead, the invention may be applied to the insole placed on a soft outsole. Thus, the invention is applicable to either part of the sole 2.

VII. The core 9 is not limited to a foam material but may be any type of material as long as it is light. Further, a material having a high specific gravity may be used to form a hollow core for lightness.

VIII. In the foregoing embodiment, the sheet layers 11a–114 contain long fibers. Sheet layers such as of a nonwoven fabric may be used instead.

What is claimed is:

1. A cycling shoe sole comprising:

a core including a top surface, a bottom surface and a side surface extending from said top surface to said bottom surface;

a cover layer enclosing said core in all directions including the top surface, bottom surface and side surface of said core, said cover layer including:

a plurality of fibrous layers overlapped with each other, said plurality of fibrous layers including a plurality of glass fiber layers enclosing said core in all directions including the top surface, bottom surface and side surface of said core, and a plurality of carbon fiber layers further enclosing said glass fiber layers in all directions including the top surface, bottom surface and side surface of said core;

wherein said plurality of carbon fiber layers includes a first carbon fiber layer and a second carbon fiber layer, wherein said first carbon fiber layer covers said top surface of said core, and said second carbon fiber layer covers said bottom and side surfaces of said core and overlaps a peripheral portion of said first carbon fiber layer on said top surface; and a resin layer integrating said plurality of said glass fiber layers and said plurality of carbon fiber layers;

wherein said resin layer integrates said core and said plurality of fibrous layers by adhering said plurality of fiber layers to said light weight core.

2. A cycling shoe sole of claim 1, wherein said core is a light weight core.

* * * * *